US005701388A

United States Patent [19]

Steinhardt et al.

[11] Patent Number: 5,701,388

[45] Date of Patent: Dec. 23, 1997

[54] COMBINED HEATER AND PUMP

[75] Inventors: Michael D. Steinhardt, Kiel; Isadore Balan, Mequon; Kenneth J. Sieth, Delafield, all of Wis.

[73] Assignee: Kohler Co., Kohler, Wis.

[21] Appl. No.: 362,671

[22] Filed: Dec. 22, 1994

[51] Int. Cl.[6] ..... F24H 1/08

[52] U.S. Cl. ..... 392/471

[58] Field of Search ..... 392/471, 476, 392/503, 360, 379, 396, 398; 219/202, 205, 206, 207, 208, 209, 400; 310/68 R; 261/142

[56] References Cited

U.S. PATENT DOCUMENTS

| | | | |
|---|---|---|---|
| 1,614,322 | 1/1927 | Smith | 392/471 |
| 1,745,231 | 1/1930 | Prusacki | 219/208 |
| 1,750,170 | 3/1930 | Frisch . | |
| 1,765,125 | 6/1930 | Brewer | 261/142 |
| 2,097,166 | 10/1937 | Stone . | |
| 2,377,027 | 5/1945 | Morgan et al. . | |
| 2,419,273 | 4/1947 | Marquette . | |
| 2,957,067 | 10/1960 | Scofield | 219/400 |
| 3,069,735 | 12/1962 | Toulmin, Jr. | 392/471 |
| 3,114,969 | 12/1963 | Roth . | |
| 3,184,353 | 5/1965 | Balamuth et al. . | |
| 3,356,873 | 12/1967 | Tamm | 310/68 R |
| 3,777,446 | 12/1973 | Graver | 219/400 |
| 3,977,073 | 8/1976 | Shirey | 29/611 |
| 4,089,105 | 5/1978 | Yeo et al. | 29/626 |
| 4,185,187 | 1/1980 | Rogers | 219/306 |
| 4,264,539 | 4/1981 | Berg | 261/142 |
| 4,539,469 | 9/1985 | Gigandet | 219/400 |
| 4,594,500 | 6/1986 | Wright | 219/296 |
| 4,599,169 | 7/1986 | Ray | 210/175 |
| 4,617,456 | 10/1986 | Richards et al. | 219/523 |
| 4,659,951 | 4/1987 | Angi et al. | 310/62 |
| 4,661,041 | 4/1987 | Hessler | 415/52 |
| 4,668,898 | 5/1987 | Harms et al. | 318/254 |
| 4,830,573 | 5/1989 | Campbell | 415/177 |
| 4,831,294 | 5/1989 | Jussila | 310/63 |
| 4,855,569 | 8/1989 | Weidemann | 219/306 |
| 4,924,069 | 5/1990 | Giordani | 219/306 |
| 4,930,168 | 6/1990 | Ferlise | 4/489 |
| 5,006,743 | 4/1991 | King et al. | 310/89 |
| 5,121,533 | 6/1992 | Saito et al. | 29/407 |
| 5,156,535 | 10/1992 | Budris et al. | 417/423 |
| 5,191,230 | 3/1993 | Heung | 307/141 |
| 5,196,989 | 3/1993 | Zslnay . | |
| 5,208,730 | 5/1993 | Tracy | 361/384 |
| 5,210,680 | 5/1993 | Scheibler | 361/384 |
| 5,224,248 | 7/1993 | Brilliant | 29/20 |
| 5,341,074 | 8/1994 | Zorzolo | 318/17 |
| 5,408,960 | 4/1995 | Woytowich | 219/208 |
| 5,466,912 | 11/1995 | Dornbush et al. | 219/400 |

*Primary Examiner*—Tu B. Hoang
*Attorney, Agent, or Firm*—Quarles & Brady

[57] ABSTRACT

A compact combined heater and pump is disclosed. There is a pump housing forming an internal pump chamber, the housing having both an inlet and an outlet and an opening therethrough. A drive shaft is rotatably mounted in the opening and is driven by a motor located outside the chamber. An impeller is mounted on the drive shaft within the housing and a heater is sandwiched in the chamber between the motor and impeller. Rotation of the shaft can draw liquid in from the inlet, past the heater and through the outlet. A cooling fan attached to the shaft for rotation therewith draws cooling air over control circuitry and then forces the air over the motor.

23 Claims, 4 Drawing Sheets

FIG. 1
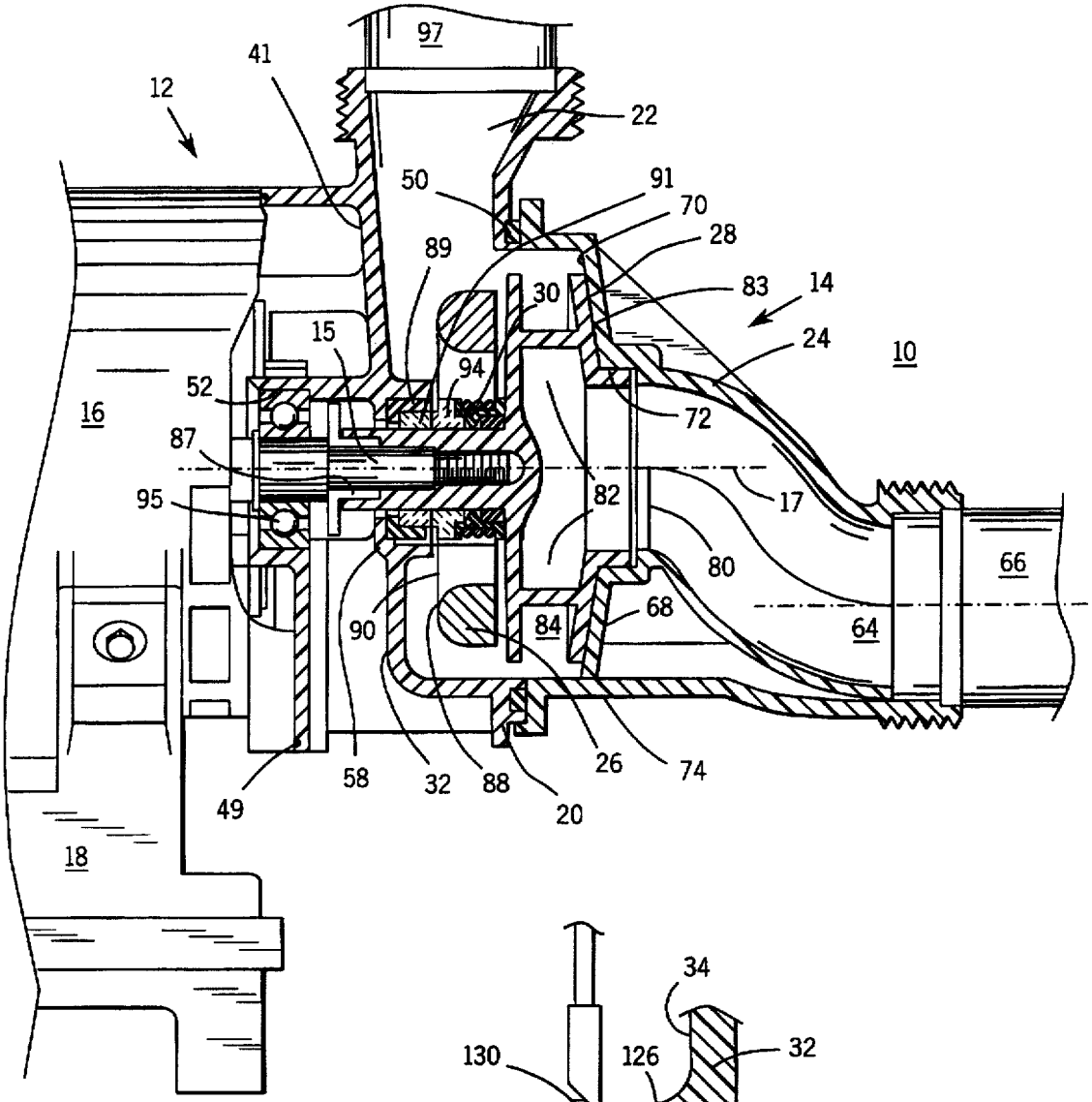
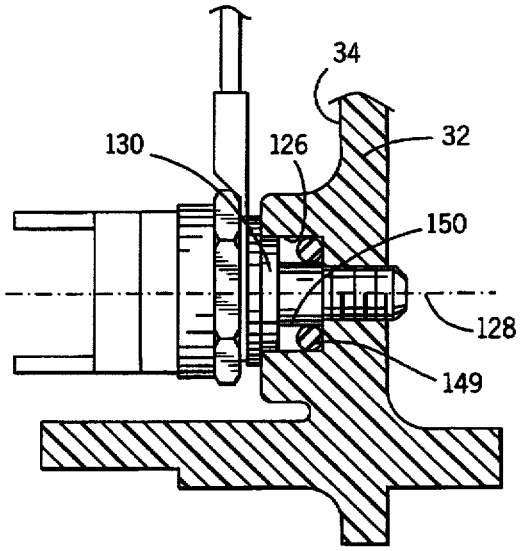
FIG. 6

COMBINED HEATER AND PUMP

FIELD OF INVENTION

The present invention relates to pumps and more particularly to a compact pump and heater for a spa or the like.

DESCRIPTION OF THE ART

It is often desirable to provide large whirlpool tubs within a relatively confined area. This is particularly true where a whirlpool system is to replace a conventional tub and must fit within an existing tub alcove. Complicating matters, a whirlpool tub must share alcove space with "hidden" whirlpool system components such as a pump, pump motor, a heating unit, control circuitry, and additional plumbing to direct water to and from the pump unit, heating unit, and tub.

It is also desirable to configure a whirlpool system so that all of the hidden components are located in a single area of the alcove. Proximate placement of components permits all components to more easily be serviced from a single port and limits the amount of plumbing required to route water.

U.S. Pat. No. 4,594,500 describes one relatively economical and serviceable pump/heating configuration wherein a pump element and a heating element are included in a single unit. Unfortunately, this design is not much smaller than the two housings it replaces.

Another problem is that during operation both the motor and control circuitry generate heat. If the heat is not dissipated properly, it can drive the operating temperature of both the motor and control circuitry outside the ideal range and eventually damage or destroy the motor and/or circuitry. By placing the motor and control circuitry within a single confined space the overheating problem is exacerbated as heat is trapped near the motor and circuitry. Furthermore, placing the heating unit in the same confined area as the motor and control circuitry would be thought to exacerbate the overheating problem.

U.S. Pat. No. 5,006,743 describes a well known fan unit which rotates with a motor shaft to cool the motor during operation. While a motor fan may sufficiently cool the motor, it does little to dissipate control circuitry heat.

Therefore, it would be advantageous to have a whirlpool system including a pump unit, heating unit, motor and control circuitry that together require minimal space. In addition, it would be desirable to have such a system that includes both a motor and control circuitry cooling mechanism.

SUMMARY OF THE INVENTION

The present invention resides in a pump for pumping and heating a liquid, the pump being drivable by a motor. In one embodiment, there is a pump housing having an internal pump chamber, a fluid inlet into the chamber, a chamber sidewall, and a radial outlet, the sidewall having an opening therethrough. The pump includes a drive shaft which is rotatably movable within the opening and is suitable to be attached to a motor located outside the chamber. An impeller mounted on the drive shaft rotates therewith in the chamber. A heater is sandwiched in the chamber between the sidewall and the impeller. Upon operation of the pump and connection of the pump to a fluid supply, rotation of the shaft draws liquid in from the inlet, past the heater and through the outlet.

In one embodiment the inlet opens into the chamber at a position opposite the side wall opening. In another embodiment, a ball bearing is included within the opening for receiving and supporting the drive shaft, a portion of the pump chamber may take the form of a volute for increasing water pressure prior to the outlet, and the heater is donut-shaped and surrounds the drive shaft.

In yet another embodiment, the pump includes an insert that is forced through the pump housing by ultrasonic vibrations, the insert having a sensing end extending into the pump chamber and a distal end located outside the pump chamber. An O-ring may be included at the junction between the insert and the pump housing for providing a seal. In addition, a sensor may be connected to the distal end of the insert and the insert may be thermally and electrically conductive. The sensor may be either a water temperature or water presence sensor.

In another embodiment, a gland is included outside the pump chamber on the pump chamber wall, the gland surrounding at least a portion of the insert and having an internal surface which opposes an external surface of the insert. The O-ring fits tightly between the internal and external surfaces.

In yet another embodiment the motor is enclosed in a motor housing having at least one air intake and a circuit housing is positioned adjacent the motor housing near the intake. The control circuitry for the motor and pump are positioned within the circuitry housing. The circuitry housing includes a chimney chute at a first end that communicates with the intake and an intake hole at a second end opposite the first end. A fan is included within the motor housing that forces air through the intake hole, over the control circuitry, through the chimney chute and intake, and over the motor.

As will be apparent from the description below, the present invention allows a user to increase the volume of a whirlpool tub by minimizing the space required for certain hidden components of a whirlpool system. The user may provide a whirlpool tub having a comfortable size even in a relatively small alcove. In addition, even a small existing alcove need not be specially altered to receive a whirlpool system including components designed according to the present invention. Furthermore, overheating problems involving the motor and control circuitry can be minimized even where all of the hidden components are located in a relatively small area.

The objects of the invention therefore include providing a heater/pump assembly of the above kind:

(a) which is inexpensive to produce;

(b) which requires a minimal amount of space;

(c) wherein the system is designed to cool both motor and control circuitry;

(d) which provides a watertight ultrasonic insert for use with a liquid pump; and (e) which is easy to service and maintain.

The foregoing and other objects and advantages of the invention will appear from the following description. In the description, reference is made to the accompanying drawings which form a part hereof, and in which there is shown by way of illustration preferred embodiments of the invention. Such embodiments do not represent the full scope of the invention. Reference is made therefore to the claims herein for interpreting the full scope of the invention.

BRIEF DESCRIPTION OF THE DRAWINGS

FIG. 1 is an axial sectional view through a pump/heater unit embodying the present invention;

FIG. 6 is an enlarged view of the ultrasonic insert shown in FIG. 1; and

DESCRIPTION OF THE PREFERRED EMBODIMENTS

Figure 2:
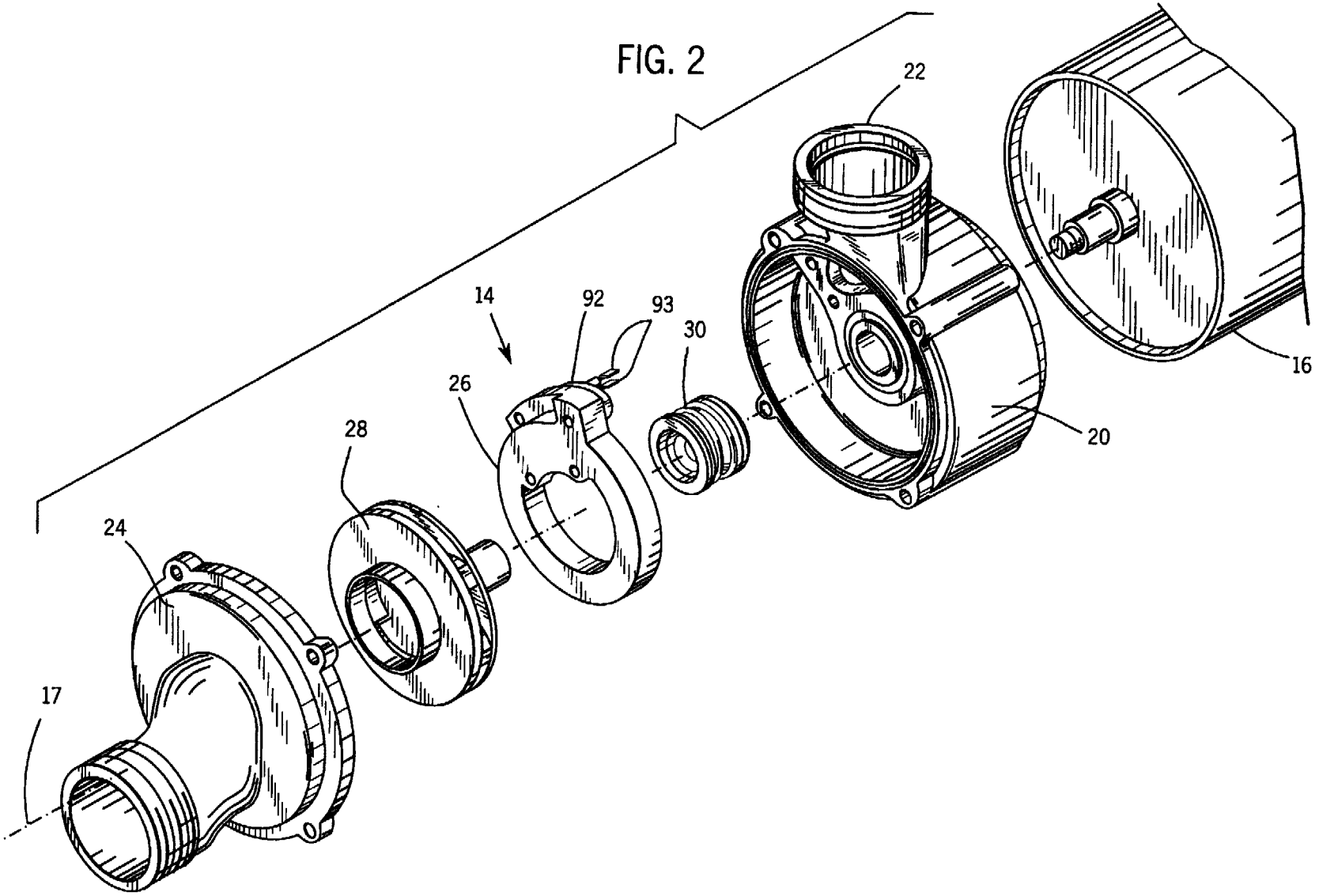
FIG. 2 is an exploded view of certain of the components of the pump/heater unit of FIG. 1.

Referring now to FIG. 1, a pumping arrangement 10 embodying the present invention includes, as its main components, a motor 12 and a pump/heater unit 14 which is mounted to the motor 12.

The motor 12 is of any known construction and includes a motor housing 16 which is supported by means of a mounting arrangement 18. In the following discussion, it will be assumed, unless otherwise indicated, that the motor housing 16 will be mounted on the mounting arrangement 18 in the illustrated position, that is, on a substantially horizontal surface of support. The motor 12 includes a drive shaft 15 which extends from the motor housing 16 for rotatable motion about an axis of rotation 17.

Referring also to FIG. 2 the pump/heater unit 14 consists primarily of a pump housing 20, a housing lid 24, a heater 26, an impeller 28, and a seal spring 30. Preferably, the pump housing 20, lid 24, heater 26, impeller 28, and spring 30 are arranged around the axis of rotation 17.

Figure 4:
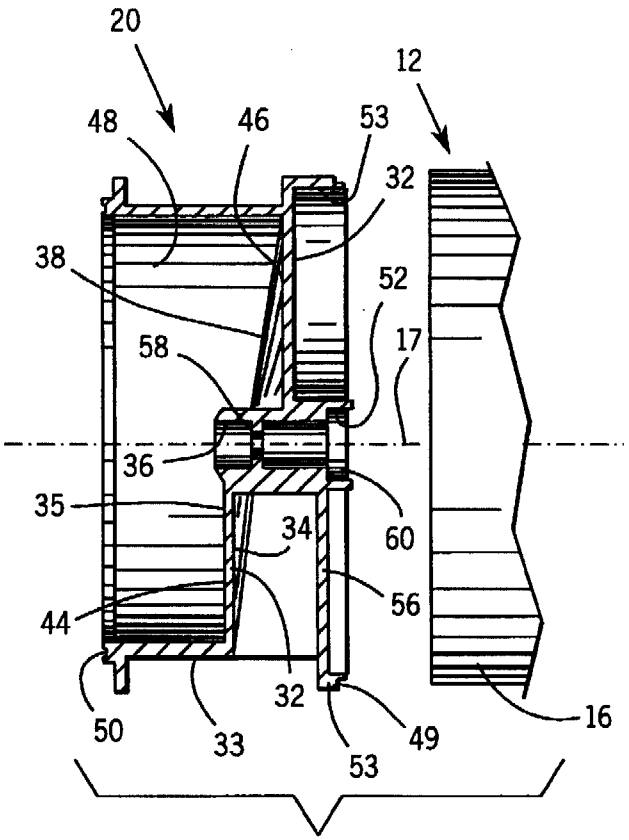
FIG. 4 is a cross-sectional view taken along the line 4—4 of FIG. 3.
Figure 3:
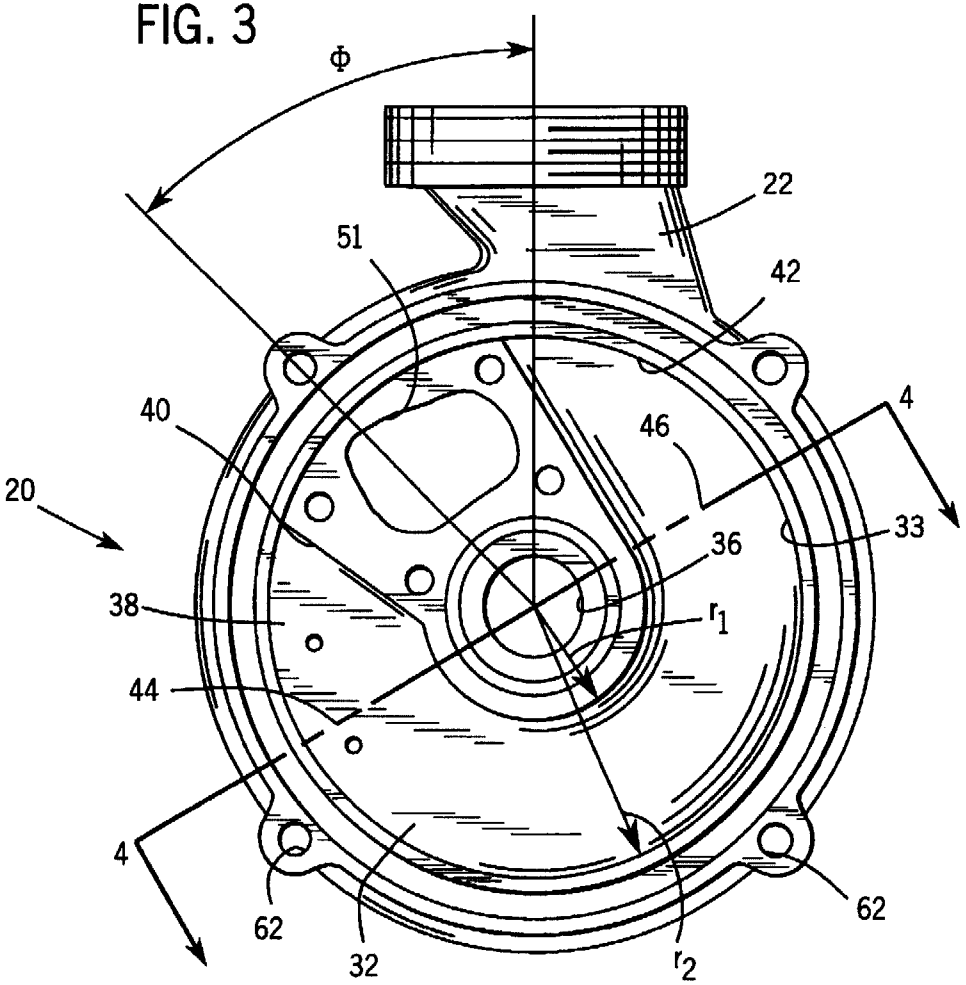
FIG. 3 is an end elevational view of the pump housing according to the invention.

Referring also to FIGS. 3 and 4, the pump housing 20 includes a base wall 32 having a substantially circular shape when viewed from an end elevational position and a cylindrical outer wall 33 which extends from the circumferential edge of the base wall 32 perpendicular to the axis of rotation 17 and in a direction away from the motor 12. The base wall 32 has an internal face 34 which faces the motor and an external face 35 facing in the opposite direction. An opening or hole 36, which is centered on the axis of rotation 17, is provided in the base wall 32. Preferably, a volute channel 38 is formed in the external face 35.

Referring specifically to FIG. 3, in the preferred embodiment, the volute channel 38 begins at an angle $\Phi$ (approximately 45°) from vertical and wraps around the hole 36 (through approximately 225°) to a point at which it follows a tangent to a lateral edge of the internal face 34. The internal $r_1$ and external $r_2$ radii of the channel 38 are constant throughout the wrapping portion of the channel 38. The depth of the channel 38 increases throughout its wrapping portion, being relatively narrow at an inlet end 40 and relatively deeper at an outlet end 42.

Referring also to FIG. 4, it can be seen that the channel 38 is one depth at a cross section 44 near the inlet end 40 and a deeper depth at a different cross sectional area 46 near the outlet end 42. A heater aperture 51 is provided in the portion of the base wall 32 that does not form the volute 38 (i.e. between the outlet 42 and the inlet 40 ends of the volute channel 38).

Central and outer support cylinders 52, 53 extend from the base wall 32 toward the motor 12 and are centered on the central axis 17. The central cylinder 52 circumscribes the hole 36, extending from the internal surface 34 of the base wall 32. Around a portion of the pump housing 20 where the volute channel 38 is relatively deep, the outer cylinder 53 extends from an external edge of the base wall 32. Where the volute channel 38 is relatively shallow, an additional support member 56 extends radially from the central cylinder 52 to support the outer cylinder 53. A recess 49 is provided on the external surface of the outer cylinder 53 along the cylinder's distal edge.

Referring still to FIG. 4, both an annular hub 58 and an annular recess 60 are provided on the internal surface of the central cylinder 52. The nub 58 is located approximately centrally within the cylinder, extends radially inwardly, and provides support for various sealing components as will be described in more detail below. Referring also to FIG. 1, the recess 60 is located on the edge of the internal surface of the cylinder 52 facing the motor 12 and provides support for a ball bearing 95 which is of a construction well-known in the art.

Referring again to FIGS. 1, 2, and 3, the pump housing 20 also includes an outlet channel 22 which extends radially from the pump housing 20. As best seen in FIG. 3, the outlet channel 22 is aligned with the outlet end 42 of the volute channel 38 so that liquid flowing in the volute channel 38 naturally proceed out the outlet channel 22. The pump housing 20 also includes four bolt holes 62 which are used to fasten the housing adjacent a motor.

Referring now to FIGS. 1 and 2, the housing lid 24 has an axially extending inlet nipple 64 which can be attached to an inlet pipe 66 in any known manner. The lid 24 includes a lid wall 68 having an internal surface 70 which forms an annular receiving shelf 72 centered on the axis of rotation 17. The lid 24, like the pump housing 20, also has a cylindrical outer wall 74 which extends parallel to the axis of rotation 17. Outer wall 74 extends in the direction of the motor 12. The radii of both the lid and housing cylindrical walls 33, 74 is identical so that when fastened together, a tight seal can be formed therebetween.

Referring to FIGS. 1 and 4, a seal receiving channel 50 is provided on the distal edge of the housing outer wall 33 for receiving an elastomeric O-ring 76. When the lid 24 is installed on the pump housing 20, the elastomeric O-ring 76 is pressed between the distal ends of the outer walls 33, 74 and forms a watertight seal therebetween.

The outer walls 33, 74 together form a pumping chamber 78 which houses the heater 26, impeller 28, and seal spring 30. The impeller 28 is of a known construction having inboard 85 and outboard 83 surfaces and includes an axial inlet 80 extending away from the motor 12, a plurality of impeller vanes 82 and a plurality of substantially radially opening outlets 84. The inlet 80 should be sized so that it fits between, and does not contact, the receiving shelf 72, so that it can freely rotate therein. The impeller 28 also includes a cylindrical shank 86 extending from a side opposite the impeller inlet 80. The shank 86 has a hollow notched bore 87 for receiving the end of the shaft 15. The distal end of the shaft 15 is threaded and the internal surface of the bore 87 is oppositely threaded so that the shaft can be securely screwed to the end of the shank 86. An annular rubber cup gasket 89 is sized so as to snugly fit within the hole 36 on the nub 58. A ceramic mating ring 91 fits within the cup gasket 89. An annular carbon seal ring 94 communicates with the mating ring 91.

Referring to FIGS. 1 and 2, the heater 26 is substantially donut-shaped having an inboard face 88 and an outboard face 90. As best seen in FIG. 2, a single mounting extension 92 extends from the inboard face 88 parallel to the axis of rotation 17. Two electrical contacts 93 extend from the distal end of the mounting extension 92 and are also parallel to the axis of rotation 17.

The heater 26 includes an electrical resistance wire inside a stainless steel tube. Electrical insulation surrounds the wire. Aluminum is cast around the stainless steel tube. The aluminum cast is grounded. As the resistance wire and tube heat up, heat transfers to the aluminum and into water therearound. Importantly, the aluminum acts as an electrical current collector for the entire tub. This eliminates the need for separate current collectors in the tub or pump apparatus. In addition, the aluminum eliminates corrosion of the heating element.

Referring to FIG. 1, the seal spring 30 is a standard helical spring having a diameter that is greater than the diameter of the shank 86 so that the shank 86 fits loosely therethrough. The diameter of the spring should be limited so that it fits within the central support cylinder 52 and is supported by the annular nub 58.

When the pump housing 20 is installed on the end of the motor housing 16, the recess 49 on the distal edge of the outer support cylinder 53 receives an adjacent edge of the motor housing 16. The drive shaft 15 extends through the central cylinder 52, cup gasket 89, mating ring 91, seal ring 94, and the seal spring 30 and is supported by the ball bearing 95. The impeller shank 86 also extends partly through the central cylinder 52 so that the distal end of the shaft 15 is securely received therein. The seal spring 30 is located around the impeller shank 86, with one end anchored on and restricted by the seal ring 94. The second end of the seal spring 30 contacts the inboard surface 85 of the impeller. Thus the spring 30 biases the cup gasket 89, mating ring 91, and sealing ring 94 toward the nub 58 in a direction away from the motor 12.

The heater 26 is positioned between the impeller 28 and the base wall 32 with its inboard surface 88 facing the base wall 32 and its outboard surface 90 facing the impeller 28.

During pump operation, fluid follows along the path indicated by arrow 160 in FIG. 1.

During rotation of the impeller 28 with the distal end of the drive shaft 15, fluid in the inlet pipe 66 is pumped through the inlet nipple 64, through the inlet 80, and impelled by the vanes 82 to move radially outwardly and eventually exits the impeller 28 through the respective outlets 84 to enter the high pressure space or pumping chamber 78 provided around the impeller 28 where the heater 26 is located. As liquid passes by the heater 26, it is heated to a desired temperature.

As known in the art, the volute channel 38 increases the water pressure as the amount of accelerated water is increased. Referring again to FIG. 3, while only a small volume of liquid has a high velocity in the shallow portion of the volute channel 38, a relatively large volume of water has high velocity in the deeper portion of the channel so that, liquid exiting the outlet end 42 forms a high velocity jet. The high velocity jet exits the outlet channel 22 and is directed by an outlet pipe to a desired destination.

By providing the ball bearing 95 within the central support cylinder 52, an end supporting portion of the motor housing which normally includes a supporting ball bearing can be eliminated. Once the end portion of the motor housing 16 is eliminated, the entire area required by the pump and motor housings 16 is reduced.

By placing the supporting ball bearing 95 closer to the motor 12 than would normally be the case, both the heater 26 and volute channel 38 can be positioned around the shaft 15 and sandwiched between the impeller 28 and the motor 12 as opposed to being positioned somewhere else. In this manner, area around the shaft 15 which would normally include the end portion of the motor housing can accommodate necessary components of the heater/pump unit 10.

By sandwiching the heater 26 between the impeller 28 and the motor 16, a plurality of collateral advantages also result. For example, it is advantageous to have any and all elements of the heater/pump unit 10 that require electricity positioned adjacent the base wall 32 of the pump housing 20. When so positioned, electricity which is required to operate the motor and control circuitry and which is therefore readily available within the motor housing 16, can also be provided through the base wall 32 and need not be provided from an external side of one of the cylindrical outer walls 33, 74. Referring again to FIGS. 2 and 3, the heater aperture 51 is provided in the base wall 32 in an area that is not within the volute channel 38. The mounting extension 92 extends through the heater aperture 51 and into the motor housing 16 where the contacts 93 can be electrically connected. A flat gasket (not shown) can be located around the mounting extension 92 to form a water-tight seal between the extension 92 and the base wall 32.

In addition, as the liquid characteristics within the deepest portion of the volute channel 38 are the characteristics of the liquid exiting the heater/pump unit 10, these are the characteristics which are most likely of interest. Referring to FIG. 1, because the deepest portion of the volute channel 38 (i.e. the exit portion) is formed by the base wall 32, sensors 152 that might require electricity can be located on the motor side of the base wall 32 with an appropriate insert extending therethrough at a point 41 within the volute channel.

It should be noted, however, that for safety purposed, it is desirable to ground all sensors that extend through the base wall 32 and into the pumping chamber 78. Grounding eliminates the possibility of electrocuting a whirlpool occupant if stray current shorts into the insert.

Figure 5:
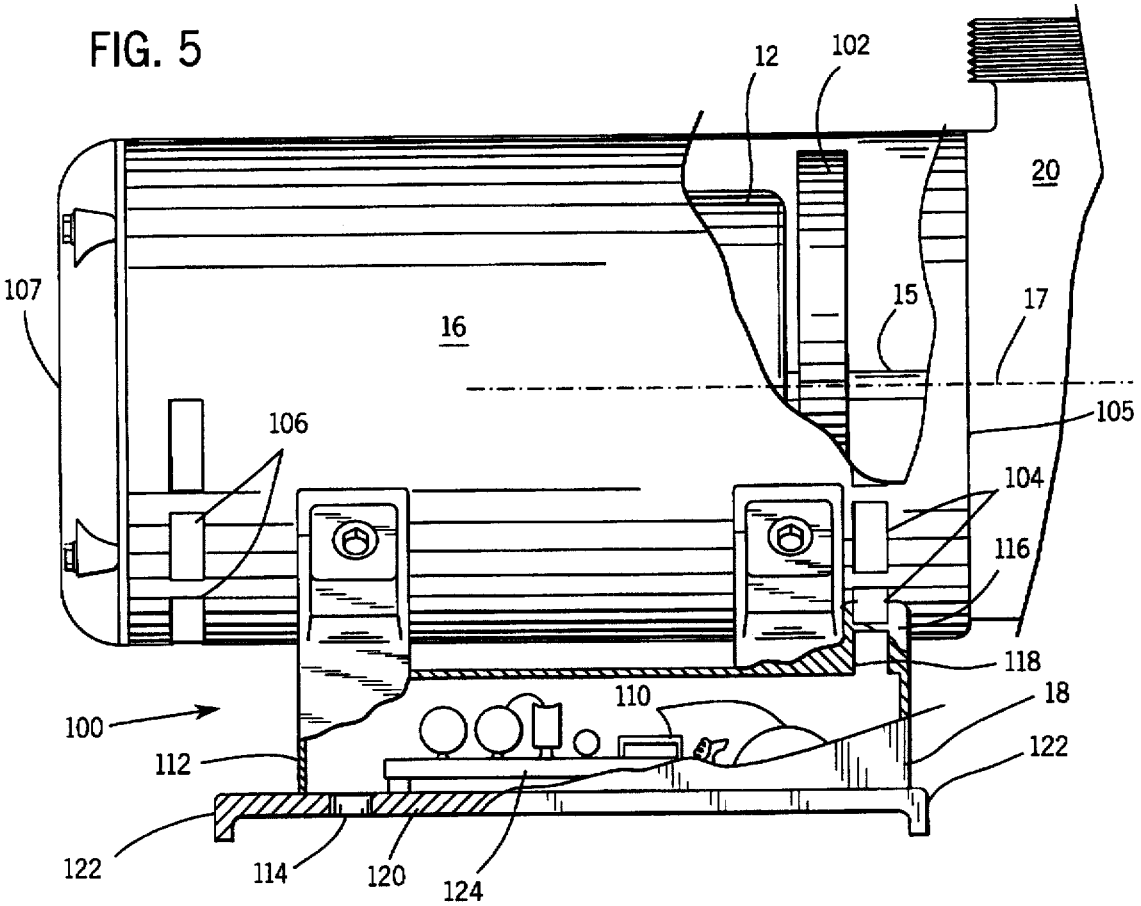
FIG. 5 is a partial cross-sectional view of a motor including a separate circuit housing according to the present invention.

Referring now to FIG. 5, the present invention also includes a circuitry cooling configuration 100. While the motor shown in FIG. 1 limits the overall size of the heater, pump, and motor, if the area provided for mounting the heater/pump unit 10 is severely restricted, both the motor 12 and control circuitry (not shown in FIG. 1) will tend to heat up at an accelerated rate and can damage or destroy both motor components or control circuitry.

The circuitry cooling configuration 100 as shown in FIG. 5 minimizes the area required for the heater/pump unit. Both a motor 12 and a fan unit 102 are located within the motor housing 16. The motor housing 16 includes a plurality of air inlets or intakes 104 positioned near a pump end 105 of the housing and a plurality of air outlets 106 at an exhaust end 107 of the motor housing.

The fan 102 may be constructed in various ways as well-known in the art but should at least include a plurality of vanes which can force air into the motor housing 16 through the inlets 104, past the motor 12, and back out of the housing 16 through outlets 106. The fan 102 is mounted on the drive shaft 15 for joint rotation about the axis of rotation 17 therewith.

In the present invention, the control circuitry 110 is mounted in a separate circuitry housing 112 located within the mounting arrangement 18.

While the circuitry housing 112 and motor housing 16 are separate, a chimney chute 116 extends from a circuitry housing outlet 118 up to at least one motor housing inlet or intake hole 104. At the opposite end of the circuitry housing 112, a circuitry housing inlet 114 is provided in a floor member 120. Support legs 122 are provided on the bottom of the floor member 120 which allow air to pass unobstructed underneath the floor member 120.

Importantly, the control circuitry 110 is located between the inlet 114 and the outlet 118. Preferably, the circuitry 110 is also attached to either the floor member 120 or a heat sink member 124.

While the motor 12 is operating, the fan 102 rotates along with the drive shaft 15. As the fan 102 rotates, the fan draws air along the path identified by arrows 162, 164 and 166 through the circuitry housing inlet 114, across the circuitry 110, through the chimney chute 116, and into the inlet 104 which is attached to the chimney chute. Importantly, the fan 102 also draws additional air through inlet holes 104 which are not connected to the chimney chute 116 thus mixing the air from the chimney chute 116 with additional cooling air prior to forcing that air over the motor 12. The cooling air absorbs much of the heat produced by the motor 12 and circuitry 110 and finally is forced out the outlets 106.

By cooling both the motor and control circuitry using a single fan, a heater can be included with both a pump and control circuitry in a relatively small space without risking damage from overheating. Minimizing the space required for these components allows a designer to maximize the size of the whirlpool tub.

One way to install an insert in the base wall 32 would be to use an ultrasonic insert. As known in the art, an ultrasonic insert is forced through a wall by a jig tool which applies pressure axially along the length of the insert while the insert is aligned with a small hole. At the same time, the insert is ultrasonically vibrated. This process continues until the insert melts forced through the hole and emerges on the other side. The vibrating melts the plastic around the hole making it easy to enforce the insert therethrough. After the vibrating is stopped, the plastic solidifies and secures the position of the insert. While manufacture and installation of such inserts is relatively inexpensive, the industry has yet to devise a waterproof insert which could be used with the base wall 32 in a liquid pump unit.

Referring to FIG. 6, to provide a watertight ultrasonic insert for use with the present invention, a cylindrical gland 126 is formed on the internal face 34 of the base wall 32. The gland 126 is formed around an insert axis 128. An ultrasonic insert 130 is also provided.

Figure 7:
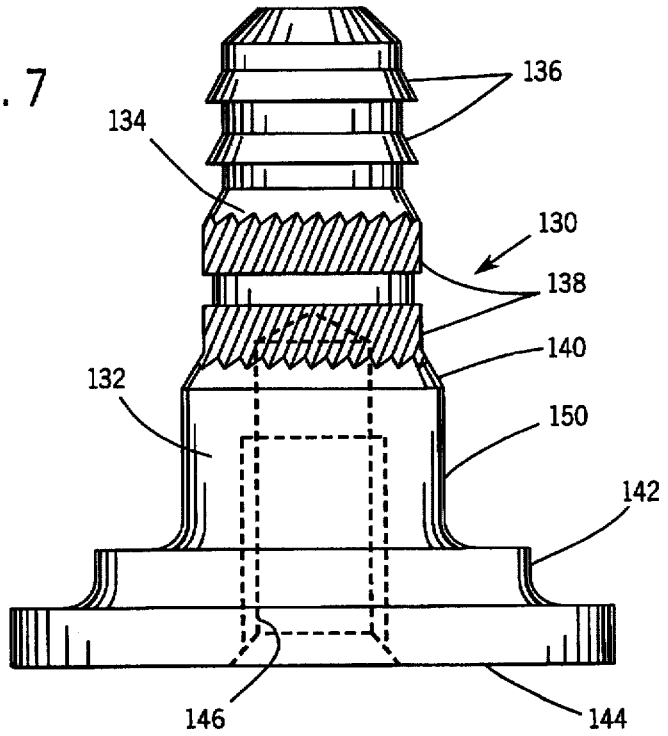
FIG. 7 is an enlarged view of an ultrasonic insert.

Referring also to FIG. 7, the insert 130 includes a head portion 132 and an extension 134. Preferably, the extension portion includes two annular nubs 136 near its distal end and two spiral knurls 138 located between the nubs 136 and the head portion 132. The head portion 132 includes a first shelf 140 adjacent the knurls 138, a second shelf 142 adjacent the first shelf 140 but separated therefrom, and a face plate 144 adjacent the second shelf 142 and opposite the distal end of the extension 134. A connection aperture 146 is provided in the face plate 144 and extends through the head portion 132 and partially into the extension 134. Preferably, the connection aperture 146 is centrally located within the head portion 132.

Referring also to FIG. 6, importantly, prior to installing the insert 130, an elastomeric O-ring 149 is positioned around the first shelf 140. The gland 126 should be sized so that the diameter between facing internal surface portions is slightly greater than the diameter of the head portion 132 through the external surface 150 so that when an O-ring 149 is placed therebetween, it is slightly compacted. To install the insert, the insert 130 is aligned with a small hole along an insert axis 128, the jig tool (not shown) applies force to the insert 130 along the insert axis 128 in the direction of the pump chamber 78, and the insert is ultrasonically vibrated until it melts through the base wall 32 so that an end is received within the pump chamber 78. As the insert 130 is vibrated, the O-ring 149 is forced up and around the external surface 150 and provides a watertight seal between the internal surface of the gland 126 and the external surface 150. The second shelf 142 is received within the gland 26 and the face plate 144 remains outside the gland 126.

It will be appreciated that in addition to the specified embodiment shown, the invention can appear in other embodiments. For example, referring to FIG. 1, it may be possible to limit the size of the heater/pump unit 10 even more if either the volute channel 38 and/or the heater 26 are positioned around the ball bearing 95.

Any type of heater that can fit in a small area and that is electrically safe could be used with the present invention. The insert shown in FIG. 7 is only shown as an exemplary insert and any type of ultrasonic insert could be used with the present invention and with the gland 126 and O-ring 149 shown in FIG. 6. Furthermore, while FIG. 5 shows one circuitry/motor housing configuration, any configuration wherein circuitry is placed in a separate housing and a fan draws cooling air over the circuitry and then forces air over the motor is contemplated by the present invention.

In addition, the control circuitry may include various temperature and water presence or water pressure sensors that operate to protect the motor and heater components. For example, a separate dual function thermostat may be thermally connected to the heater to provide various functions. First, if the pump is turned on and there is minimal or little water in the pump and the tub, the heater temperature rises rapidly and could result in a dry fire. The thermostat can be used to directly shut off the heater to prevents dry fires. Second, the same thermostat can be used to provide an upper temperature limit which prevents water temperatures from exceeding 120° F. which is the upper temperature allowed.

We claim:

1. A pump for pumping and heating a liquid, the pump being drivable by a motor, the pump comprising:

a pump housing having an internal pump chamber, a liquid inlet into the chamber, a chamber base wall, and a radial outlet, the base wall having an opening therethrough;

a drive shaft rotatably mounted in the opening, the shaft being suitable to be attached to a motor located outside the chamber;

an impeller mounted on the drive shaft to rotate therewith in the chamber, the impeller mounted such that the outlet is between the impeller and the base wall; and a heater sandwiched in the chamber between the base wall and impeller;

whereby upon operation of the pump and connection of the pump to a liquid supply, rotation of the shaft can draw liquid in from the inlet, past the heater and through the outlet.

2. The pump of claim 1, wherein the inlet opens into the chamber at a position opposite the base wall opening.

3. The pump of claim 1, wherein the drive shaft is an armature of a motor.

4. The pump of claim 1 wherein the heater includes an electrically resistive heating element, an electrical insulator around the heating element, and an electrically and thermally conductive cover covering the insulator, the cover being grounded, so that the cover operates as a current collector.

5. The pump as recited in claim 4 wherein the cover includes a stainless steel tube surrounding the insulation and an aluminum coating cast around the stainless steel tube and the aluminum is grounded.

6. The pump as recited in claim 1, wherein a portion of the pump chamber is a volute having a volute inlet end and a volute outlet end and wherein the volute is deeper at the outlet end than at the inlet end.

7. The pump as recited in claim 1 wherein a ball bearing is included within the opening for receiving and supporting the drive shaft.

8. The pump as recited in claim 1, further including at least one insert that has been forced through the pump housing by ultrasonic vibrations, the insert having an extension extending into the pump chamber and a head end located outside the pump chamber.

9. The pump as recited in claim 8, wherein there is an O-ring at a junction between the insert and the pump housing for providing a seal.

10. The pump as recited in claim 8, wherein a sensor is connected to the head end of the insert.

11. The pump as recited in claim 10 wherein the sensor is a dual function thermostat that can detect water presence and water temperature.

12. The pump as recited in claim 11 wherein the sensor can turn off the heater when no water is present in the pump or when the water temperature exceeds a temperature limit.

13. The pump of claim 10, wherein the insert is thermally and electrically conductive.

14. The pump as recited in claim 10, wherein the sensor is either a water temperature, water pressure, or a water presence sensor.

15. A pump for pumping and heating a liquid, the pump being drivable by a motor, the pump comprising:

a pump housing having an internal pump chamber, a fluid inlet into the chamber, a chamber base wall, and a radial outlet, the base wall having an opening therethrough;

a drive shaft rotatably mounted in the opening, the shaft being suitable to be attached to a motor located outside the chamber, the drive shaft being an armature of a motor;

an impeller mounted on the drive shaft to rotate therewith in the chamber;

a heater sandwiched in the chamber between the base wall and impeller;

whereby upon operation of the pump and connection of the pump to a liquid supply, rotation of the shaft can draw liquid in from the inlet, past the heater and through the outlet;

the motor is enclosed in a motor housing having at least one air intake, and there is a circuit housing positioned adjacent the motor housing near the intake;

control circuitry for the motor and pump is positioned within the circuit housing;

the circuit housing including a chimney chute at a first end that communicates with the intake and an intake hole at a second end opposite the first end; and the motor includes a fan within the motor housing that forces air through the intake hole, over the control circuitry, through the chimney chute and intake, and over the motor.

16. The pump as recited in claim 15, wherein there are a plurality of air intakes to the motor housing, and the chimney chute communicates with less than all of the air intakes.

17. The pump as recited in claim 1, wherein the heater is donut-shaped and surrounds the drive shaft.

18. A motor unit comprising:

a motor positioned within a motor housing, the motor being controlled by a control circuitry, the motor housing having at least one air intake;

the control circuitry located in a separate chamber from the motor in a position adjacent and upstream the intake; and a fan connected to the motor, the fan forcing cooling air to traverse an air path over the control circuitry, through the intake, and then over the motor.

19. The motor unit as recited in claim 18, wherein the fan is positioned in the motor housing along the air path between the control circuitry and the motor.

20. The motor unit as recited in claim 18 further including a circuit housing outside the motor housing that defines the separate chamber, the circuit housing having at least one outlet hole at a first end and a chimney chute providing a passage from the outlet hole to the intake and at least one air inlet.

21. A pump comprising:

an internal chamber defined by a pump chamber wall;

an insert that has been ultrasonically driven through the chamber wall so that an extension of the insert extends into the chamber; and an O-ring positioned at a seam between the insert and the chamber wall for providing a seal.

22. The pump of claim 21, wherein the insert is electrically and thermally conductive.

23. The pump as recited in claim 21 wherein a gland is included outside the pump chamber on the pump chamber wall, the gland surrounding at least a portion of the insert and having an internal surface which opposes an external surface of the insert, wherein the O-ring tightly fits between the internal and external surfaces.

* * * * *